US008465337B2

(12) United States Patent
Eisenhut et al.

(10) Patent No.: US 8,465,337 B2
(45) Date of Patent: Jun. 18, 2013

(54) RADIATION CURABLE ARTS AND CRAFTS TOY

(76) Inventors: Anthony R. Eisenhut, Lansing, NY (US); Eric D. Eisenhut, Ithaca, NY (US)

( * ) Notice: Subject to any disclaimer, the term of this patent is extended or adjusted under 35 U.S.C. 154(b) by 641 days.

(21) Appl. No.: 12/213,309

(22) Filed: Jun. 18, 2008

(65) Prior Publication Data

US 2008/0318489 A1 Dec. 25, 2008

Related U.S. Application Data

(60) Provisional application No. 60/929,201, filed on Jun. 18, 2007.

(51) Int. Cl.
*A63H 33/00* (2006.01)

(52) U.S. Cl.
CPC ..... *A63H 33/001* (2013.01)
USPC ..... 446/87; 446/86; 446/217; 446/385; 219/220; 433/29; 433/214; 433/215; 434/81; 434/82; 249/78; 249/117

(58) Field of Classification Search
USPC ..... 446/87, 217, 385, 175, 219, 481, 446/484; 219/220; 425/DIG. 57; 433/29, 433/214–215; 434/81–82; 249/78, 117, 112, 249/127
See application file for complete search history.

(56) References Cited

U.S. PATENT DOCUMENTS 2,718,668 A * 9/1955 Burke ..... 264/245
3,063,109 A * 11/1962 Rapaport ..... 164/412
3,368,063 A * 2/1968 Kuhn ..... 219/411
3,432,581 A * 3/1969 Rosen ..... 264/45.5
3,493,382 A * 2/1970 Burns et al. ..... 426/573
3,598,358 A * 8/1971 Clearwaters et al. ..... 249/117
4,183,883 A * 1/1980 Blair ..... 264/40.1
4,188,009 A * 2/1980 Gillespie ..... 249/78
4,215,843 A * 8/1980 Gay et al. ..... 249/78
4,231,181 A * 11/1980 Fabricant ..... 446/337
4,249,067 A * 2/1981 Cummings ..... 219/392
4,298,788 A * 11/1981 Jones et al. ..... 219/386
4,299,548 A * 11/1981 Saffer et al. ..... 425/173
4,320,157 A * 3/1982 von Hagens ..... 428/13
4,451,529 A * 5/1984 Kerr et al. ..... 428/319.3
4,481,162 A * 11/1984 Huffman ..... 264/334
4,543,063 A * 9/1985 Cohen ..... 433/175
4,563,573 A * 1/1986 Hartelius et al. ..... 219/405
4,675,506 A * 6/1987 Nusbaum et al. ..... 219/405
4,828,116 A * 5/1989 Garcia ..... 206/575
4,867,680 A * 9/1989 Hare et al. ..... 433/37
4,867,682 A * 9/1989 Hammesfahr et al. ..... 433/37
4,890,997 A * 1/1990 Beins et al. ..... 425/174
4,894,000 A * 1/1990 Coates, Jr. ..... 425/190
5,040,964 A * 8/1991 Oppawsky et al. ..... 425/135

(Continued)

*Primary Examiner* — Gene Kim
*Assistant Examiner* — Alexander Niconovich
(74) *Attorney, Agent, or Firm* — Welsh Flaxman & Gitler LLC

(57) ABSTRACT

A kit and method for creating a 3-dimensional toy includes a battery powered light, a container filled with a light curable polymer and one or more molds into which the light curable polymer is inserted. Optimal the kit may also include one or more sheets of transparent material to which the light curable polymer does not adhere and coloring which can be added to the light curable polymer. The method of forming a the 3-dimensional toy involves obtaining a mold, dispensing a light curable polymer into the mold; and then curing the polymer by applying light in the visible or near visible range to the polymer via a battery powered light.

14 Claims, 3 Drawing Sheets

U.S. PATENT DOCUMENTS 5,088,598 A * 2/1992 Iguchi ..... 206/223
5,135,686 A * 8/1992 Masuhara et al. ..... 264/406
5,316,473 A * 5/1994 Hare ..... 433/29
5,346,656 A * 9/1994 Shafir ..... 264/489
5,401,152 A * 3/1995 Jacino et al. ..... 425/12
5,418,112 A * 5/1995 Mirle et al. ..... 430/269
5,422,458 A * 6/1995 Simmel ..... 219/391
5,435,518 A * 7/1995 Iguchi ..... 249/55
5,453,000 A * 9/1995 Lebensfeld ..... 425/152
5,453,287 A * 9/1995 Close ..... 426/512
5,487,662 A * 1/1996 Kipke et al. ..... 433/37
5,528,014 A * 6/1996 Goldberg et al. ..... 219/386
5,560,940 A * 10/1996 Breuil ..... 425/151
5,562,927 A * 10/1996 Masuda et al. ..... 425/98
5,597,593 A * 1/1997 Lebensfeld et al. ..... 425/441
5,716,253 A * 2/1998 Aoki et al. ..... 446/14
5,727,979 A * 3/1998 Spector ..... 446/87
5,858,262 A * 1/1999 Lebensfeld ..... 249/98
5,934,969 A * 8/1999 Rehkemper et al. ..... 446/385
5,954,115 A * 9/1999 Lebensfeld et al. ..... 164/152
5,954,561 A * 9/1999 Cannone ..... 446/75
6,033,286 A * 3/2000 Langlinais ..... 446/481
6,159,005 A * 12/2000 Herold et al. ..... 433/29
6,273,780 B1 * 8/2001 Gardner ..... 446/268
6,589,096 B1 * 7/2003 Doane et al. ..... 446/385
6,611,110 B1 * 8/2003 Fregoso ..... 315/224
6,692,251 B1 * 2/2004 Logan et al. ..... 433/29
6,719,558 B2 * 4/2004 Cao ..... 433/29
6,786,728 B2 * 9/2004 Leblanc et al. ..... 434/84
6,857,873 B2 * 2/2005 Bianchetti et al. ..... 433/29
6,902,387 B2 * 6/2005 Cziraky ..... 425/144
7,052,261 B2 * 5/2006 Fernandez et al. ..... 425/136
7,182,597 B2 * 2/2007 Gill et al. ..... 433/29
7,182,902 B2 * 2/2007 Cziraky ..... 264/299
7,282,671 B1 * 10/2007 Hamilton ..... 219/386
7,410,667 B2 * 8/2008 Eisenhut et al. ..... 427/140
7,645,056 B1 * 1/2010 Mills et al. ..... 362/294
2005/0008729 A1 * 1/2005 Fernandez et al. ..... 425/256
2006/0017198 A1 * 1/2006 Koehl ..... 264/319
2010/0052222 A1 * 3/2010 Kimmel et al. ..... 264/401

* cited by examiner

RADIATION CURABLE ARTS AND CRAFTS TOY

CROSS REFERENCE TO RELATED APPLICATION

This application claims the benefit of U.S. Provisional Application Ser. No. 60/929,201, entitled "Radiation Curable Arts and Crafts Toys", filed Jun. 18, 2007.

BACKGROUND OF THE INVENTION

1. Field of the Invention

The present invention is directed to a radiation curable arts and crafts toy in the form of a kit wherein three-dimensional articles shaped with or without a mold or shaped using hand malleable molds are formed using visible or near visible light curable polymers. The method uses radiation curable polymers to create crafts, toys, science kits, "clay-type" molds, building sets, ornaments, and the like.

2. Description of the Related Art

Creating formed objects using mediums such as baked clay generally requires both an extended period of time and extremely high temperatures. As such, it is an adult oriented project that takes long periods of time not allowing children to participate on their own because of safety concerns. Children's toys such as Legos, Lincoln Logs and erector sets do not allow for the kids to be part of the fabrication of the materials used. Toys like bake ovens also require adult supervision. The ability for the children to create various 3-dimensional structures such as those resembling logs, blocks, stone, or wood or other building material would be both a unique experience and an excellent teaching tool.

Molding devices for making toys have been popular with children for generations. They can be used to melt and mold waxes, resins, thermoplastics or certain metal alloys to make interesting objects. However, the melting and molding process typically requires a heat source and relatively high temperatures. Although nothing can be completely safe, previous molding toys have not been as simple or as safe as today's parents desire.

U.S. Pat. No. 3,063,109, issued to Rapaport, describes a toy casting machine for melting metal which includes an electrically heated melting chamber. The Rapaport patent reports that the toy casting machine is safe because the melting chamber is covered during operation. However, the path of molten material from a discharge spout to the mold is freely accessible to any child who operates the toy casting machine. If the mold were to overflow, or the molten material were to leak from the mold for any reason, a child operator might impulsively intervene by, for example, placing his or her fingers in the path of the molten material. Also, it is possible that some children will attempt to add additional solid material to the melting chamber during operation.

U.S. Pat. No. 4,299,548, issued to Saffer et al., and U.S. Pat. No. 5,954,115, issued to Lebensfeld et al., describe toy casting machines for melting plastic that include melting chambers rotatably mounted so that they can be tipped to pour molten material into a mold. In both of these patents, the melting chamber and molding area are surrounded by a protective housing. However, rotatably mounted melting chambers are inherently prone to accidental rotation and discharge and are, therefore, undesirable in a toy for children.

U.S. Pat. No. 4,188,009, issued to Gillespie, includes an apparatus for reclaiming broken and worn crayons comprising a radiant and convective heat supply in the form of an electric light bulb. A housing, which has a heat reflective surface, surrounds the light bulb and forms chutes for receiving broken and worn crayons. Molds are arranged beneath the chutes and when the crayons have melted, crayon material flows from the chutes to the molds under the influence of gravity. However, the light bulb that supplies radiant and convective heat appears to be freely accessible to a child who uses the apparatus.

Similarly, toys which enable children to make toy figures of a flexible or edible character have become popular. Generally, such toys include a chemical composition, which may be conveniently contained within a plastic squeeze bottle, which composition adopts certain characteristics in response to changes, such as temperature or pressure. Conveniently, such toys will include molds having patterns embossed therein for the creation of toy figures or creatures which may simulate insects, monsters, or science-fiction type characters. Such molds are static in nature and may be one or two parts, that is, they may have a single cavity into which the composition is poured or may be two-sided to create a three dimensional object wherein the two sides of the mold have mating cavities configured to create a given object.

In such a toy molding apparatus, heat is generally required, the heat usually taking the form of an electrical light bulb which necessitates connection to normal household alternating current. The heat from such heat sources is usually concentrated and certain precautions must be taken with respect to the use of such objects or toys by children.

A need exists for a safe and simple molding device for use by children. Desirably, the toy molding process would protect children from the hot molten material.

SUMMARY OF THE INVENTION

It is, therefore, an object of the present invention to provide a toy forming kit and method of forming a toy using a battery powered light source.

More desirably, the toy molding process will employ stationary or handheld ultraviolet curing sources and molds that can be hand-shaped. Use of a visible or near visible light cure material will be of significant value to schools and community centers that currently use high temperature ovens for making objects out of clay. Use of a rapid light cure material would allow for the quick molding of object without requiring supervision.

Accordingly, it is an object of this invention to provide a new and improved toy molding kit and material for use therewith.

The kit for creating a 3-dimensional toy includes a battery powered light, a container filled with a light curable polymer and one or more molds into which the light curable polymer is inserted. Optimal the kit may also include one or more sheets of transparent material to which the light curable polymer does not adhere and coloring which can be added to the light curable polymer.

Further the one or more molds included in the kit may be preformed, malleable or a combination thereof.

Still further the battery powered light is a flashlight or in the form of an oven.

Additionally, the container is a dispensing container through which the light curable polymer is dispensed.

Further, the light curable polymer is cured in either the visible or near visible light ranges.

Still further the components of the kit are all contained within a single package.

Another object of the invention is to provide a method of forming a 3-dimensional toy including the following steps obtaining a mold, dispensing a light curable polymer into the mold; and then curing the polymer by applying light in the visible or near visible range to the polymer via a battery powered light.

It is another object of this invention to provide a new and improved toy molding kit having a hand malleable mold.

It is a further object of this invention to provide a visible or near visible light curable composition for use with the toy molding kit with the composition curing at room temperature.

Other objects and advantages of the present invention will become apparent from the following detailed description when viewed in conjunction with the accompanying drawings, which set forth certain embodiments of the invention.

DESCRIPTION OF THE PREFERRED EMBODIMENTS

The detailed embodiment of the present invention is disclosed herein. It should be understood, however, that the disclosed embodiment is merely exemplary of the invention, which may be embodied in various forms. Therefore, the details disclosed herein are not to be interpreted as limiting, but merely as a basis for teaching one skilled in the art how to make and/or use the invention.

Figure 1:
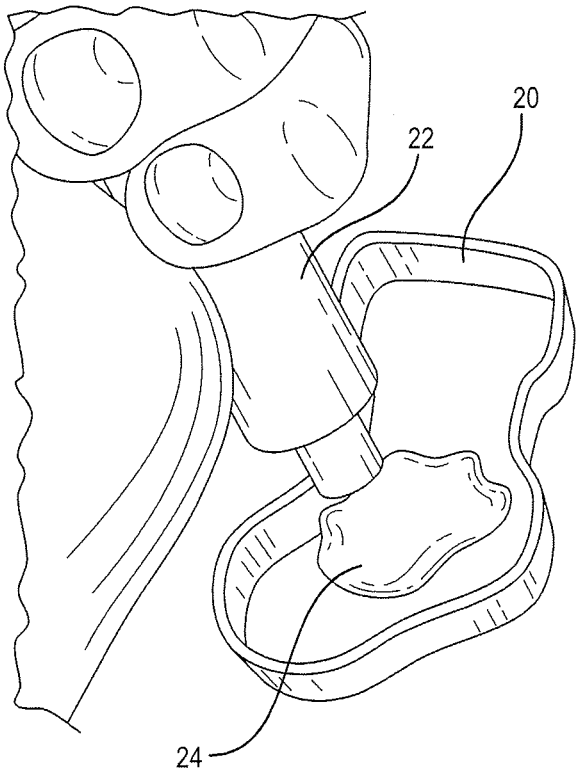
FIG. 1 is a view showing the viscous light curable polymer being dispensed into a preformed mold.
Figure 2:
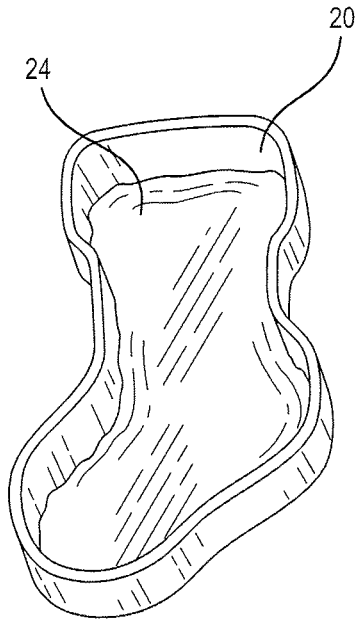
FIG. 2 is a view showing the step of the light curable polymer dispensed in FIG. 1 being cured by a light source.
Figure 3:
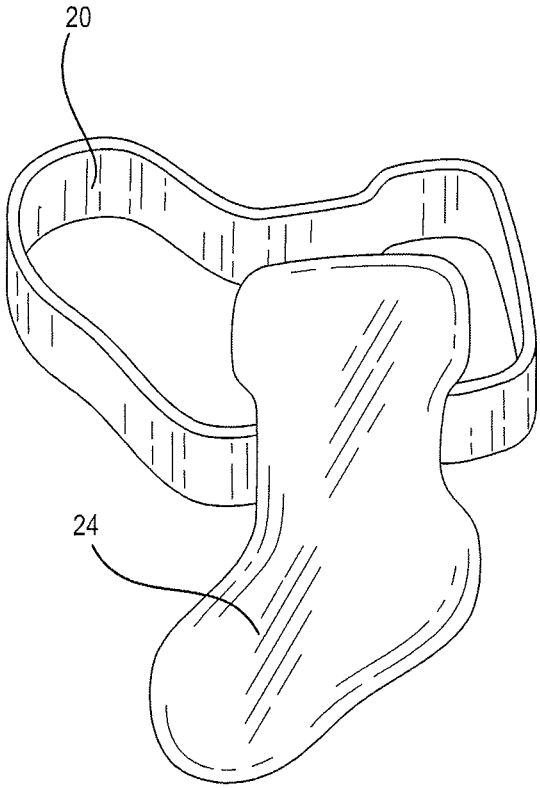
FIG. 3 is a view of the toy created after the curing step shown in FIG. 2.
Figure 4:
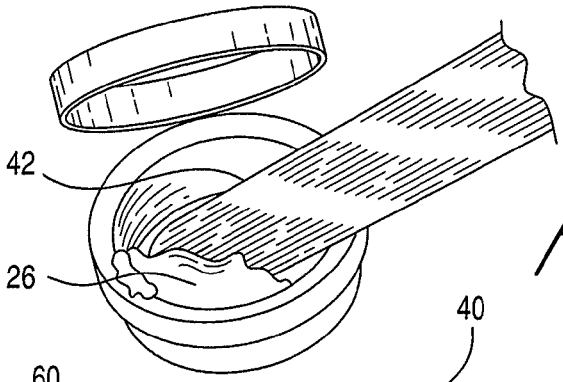
FIG. 4 is a view of a gel form of the light curable polymer being used in combination with a malleable mold and formed on top of a transparent sheet.
Figure 5:
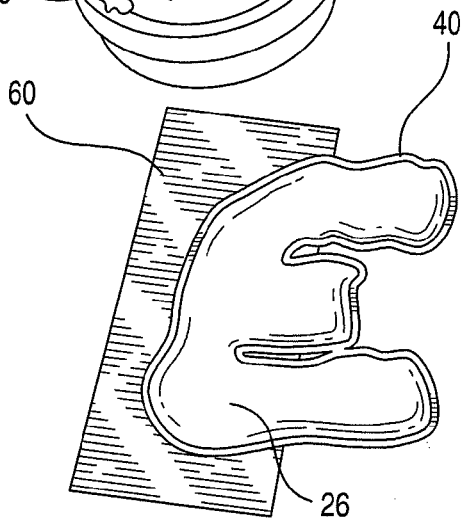
FIG. 5 is a view showing the step of the light curable polymer formed without a mold and then cured by a light source.
Figure 6:
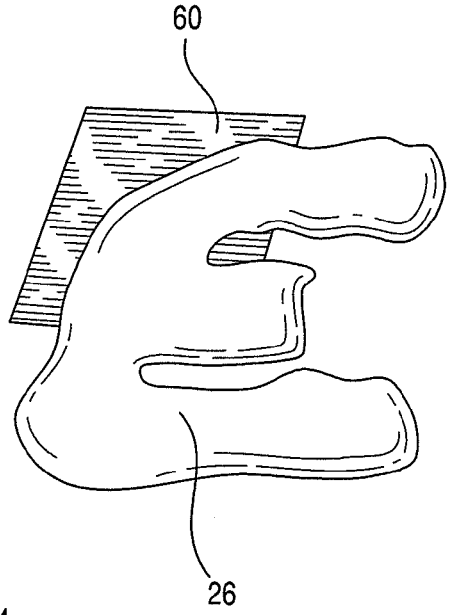
FIG. 6 is a view of the toy created after the curing step shown in FIG. 5.
Figure 6:
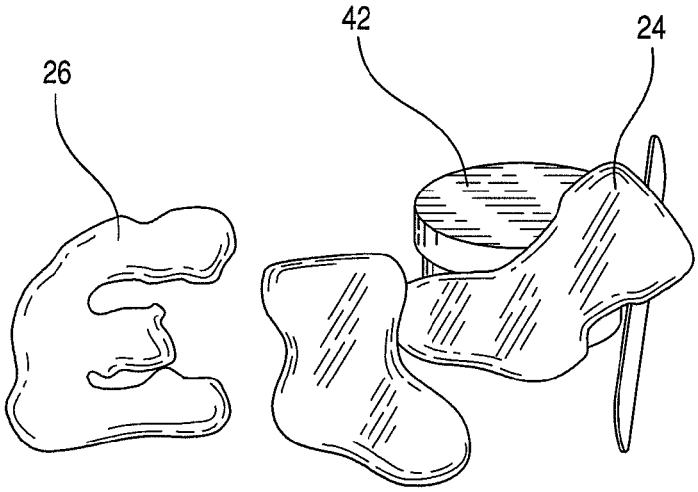
Figure 7:
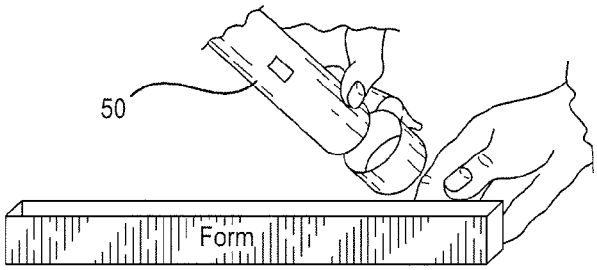
FIG. 7 is a view showing a battery powered light source to form a 3-dimensional toy.
Figure 8:
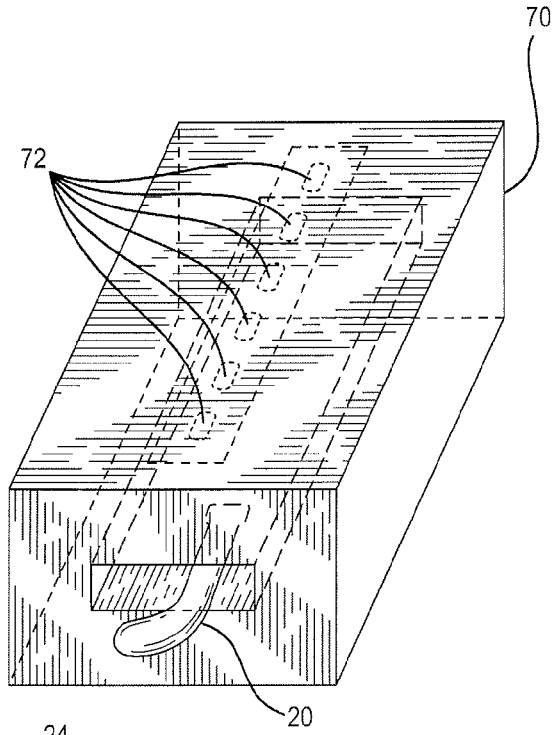
FIG. 8 shows an oven used in accordance with the present invention.
Figure 9:
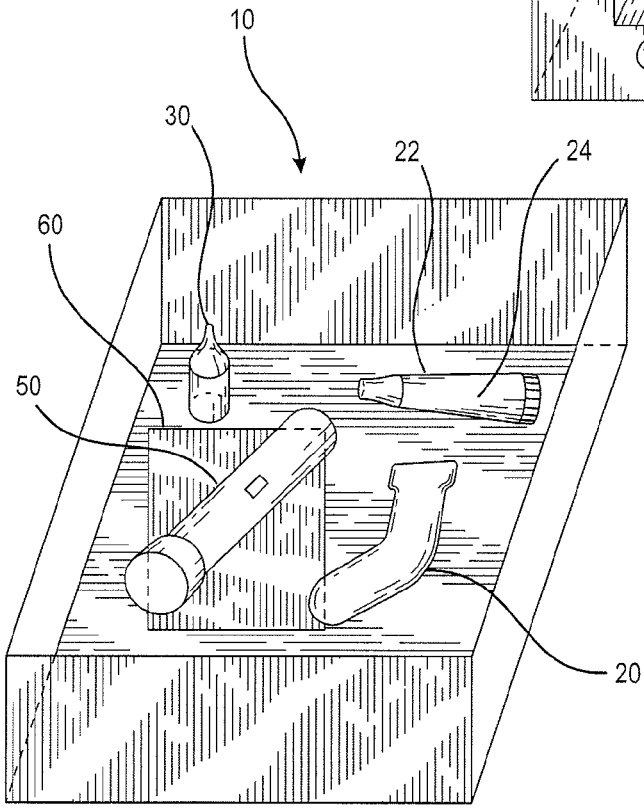
FIG. 9 is a view of the kit in accordance with the present invention.

In the method of the present invention a kit 10 is supplied having a dispensing squeeze container 22 of a visible or near visible light curable polymer 24 in the form of a fluid or gel of a first viscosity as shown in FIG. 1 or a container 42 of a lower viscosity "clay-type" visible or near visible light curable polymer 26 in the form of a gel as shown in FIG. 4, various preformed molds 20 and hand malleable molds 40, and a visible or near visible light source in the form of a battery powered flashlight 50 capable of providing sufficient curing energy to the fluid/gel. When the gel is placed in one of the molds the light source is used to crosslink the components in the gel into a form a solid. The kit 10 may also include a toy oven 70 having mounted therein a visible or near visible light source, LEDs 72, capable of curing the visible or near visible light curable material. Generally the curing light wavelength ranges between 350-750 nm. Additionally, the kit 10 will include transparent sheets 60 to which the polymer does not adhere for example, Polychlorotrifluoroethylene (PCTFE). These sheets are used under the molds or without any molds, as shown in FIG. 5, if a user wants to create their own designs and the light curable polymer is dispensed thereon such that it can be easily removed therefrom after curing.

FIGS. 1-7 show various objects being created with different viscosity materials and with preformed molds, malleable molds and no molds.

The present invention utilizes light activated radiation-curable, polymeric composition, such as an ultraviolet-curable formulation of an unsaturated resin, a monomer and a photo initiator, and a viscosity modifier and a filler. The radiation-curable compositions employed in the invention are preferably those photo-curable acrylate systems which comprise in combination an unsaturated resin or polymer, a multifunctional cross-linking diluent and a small amount of a photo initiator, and optionally other additives, such as synergistic or small amounts of photo synergists, reactive and nonreactive oligomers, and when desired, stabilizers, antioxidants, dyes, pigments, fillers, and the like.

The moldable material of the present invention is safe for children to use, gelatinous or malleable in nature at room temperature, but is curable to a solid when placed in a mold and exposed to visible or near visible light at room temperature. The visible or near visible light curable unsaturated resins employed in the present formulation may be composed of a variety of materials which include, but are not limited to, acrylated polyethers, acrylated polyester-based urethanes, methacrylate polyesters, acrylated epoxy resins. The multifunctional monomers are typically cross-linking di and multifunctional acrylates, such as, for example, neopentyl glycol diacrylate, hexanediol diacrylate, pentaerythritol triacrylate and trimethylolpropane triacrylate. Optionally, photo-curable formulations may include a monofunctional acrylate diluent, such as 2-ethylhexylacrylate, hydroxyethylacrylate, isodecylacrylate, methylcellosolve acrylate, cellosolve acrylate and the like. Various nonreactive additives, such as oligomers and polymers, may be employed typically in minor amounts, such as, for example, polyvinyl acetate resins.

The ultraviolet photo-curable formulations require the presence of a small initiating amount of a photo initiator, such as, for example, in acrylates the use of benzophenone, benzoinethylether or 2,2-diethoxyacetophenone. Such initiators are known to those skilled in the art, such as camphor quinone. In the preferred process as described and set forth herein, the radiation, cross-linkable, curable, polymer formulations are cross-linked employing light radiation, and particularly ultraviolet (visible or near visible light) light, to effect cross-linking and curing.

It is recognized that a wide variety of radiation may be employed utilizing various ionizing radiation doses, for example, greater than 0.1, such as 0.1 to 10, megarads, and may also be employed to obtain a high degree of crosslinking. Such method of radiation may be employed where economy permits such technique of curing of the polymers with a portable visible or near visible light lamp or other sources which produce visible or near visible light energy to effect cross-linking of the curable polymer. Radiation and crosslinking can be desirably effected at room or production temperatures, but if desired, may also be effected at slightly lower or elevated temperatures, particularly if such temperatures are useful in providing increased curing speeds. In ultraviolet-curable formulations, the formulation, particularly as a formed article, is exposed for a short period of time, typically 5 to 240 seconds, preferably less than a minute, to an ultraviolet source, such as a portable light sources such as LED flashlight; AC or DC powered light sources with an LED array embedded in a housing of varying sizes (as small as a lunch box or as large as an oven), or a mercury vapor lamp, to accomplish the desired polymerization.

The preformed and hand malleable molds of the present invention can be formed from a variety of materials. The preformed molds can be made of any material, preferably material that permits the passage of visible or near visible light to cure and solidify the contained gel. The hand malleable molds may consist of a soft flexible metal or elastomer that can be used to form a retaining outer perimeter that is shaped into the desired form. The perimeter mold can be placed on a suitable surface such as wax paper, aluminum foil or any surface that would enable easy removal of the cross-linked product from its surface. These hand malleable or moldable perimeter molds will inspire creativity in children since they will be the creator of the final mold design. After the gel material has hardened in the respective mold cavities, the child simply removes the formed parts from the respective mold cavities. When a toy oven having a visible or near visible light source mounted therein is used, the mold can be removed immediately unlike heated molds that cannot be removed from the oven until it has cooled to a predetermined safe temperature.

The visible or near visible light curable polymers of the present invention can be formulated in any color and mixtures of different colors can be put into or mixed in any mold. Alternatively, food coloring 30 could be used to formulate any color, and the choice of color is only limited by the children's imagination. Once the product has been cured it can be further decorated using paints or markers which can be enclosed as part of the kit 10 or obtained separately.

In accordance with the preferred embodiment, one or more molds, several visible or near visible light curable plastic resin materials packaged in light shielding squeeze tubes and a light source are sold together as a kit. Any conventional packaging may be employed, for example, a carton, or a bubble pack in which at least one mold and visible or near visible light curable plastic material squeeze tube is included. The kit 10 may also include a toy oven having a visible or near visible light source preferably powered by batteries, instead of AC source.

Although the invention has been described with reference to preferred embodiments, it will be apparent to one skilled in the art that variations and modifications are contemplated within the spirit and scope of the invention. Also, plastic materials light curing resins other than those identified herein may be used. Such materials will change state when exposed to visible or near visible light and will be safe for children to use.

While the preferred embodiments have been shown and described, it will be understood that there is no intent to limit the invention by such disclosure, but rather, is intended to cover all modifications and alternate constructions falling within the spirit and scope of the invention.

The invention claimed is:

1. A kit for creating a 3-dimensional toy, comprising:
a separate battery powered flashlight;
a separate container filled with a light curable polymer;
a plurality of separate perimeter only molds into which the light curable polymer is inserted to define only the sides of the toy; and
at least one sheet upon which the molds can be placed to define the bottom of the toy and to which the light curable polymer does not adhere.

2. The kit of claim 1 wherein one or more of the plurality of separate perimeter only molds are preformed molds.

3. The kit of claim 1 wherein one or more of the plurality of separate perimeter only molds are hand malleable molds.

4. The kit of claim 1 wherein one or more of the plurality of the separate perimeter only molds includes at least one preformed mold and at least one hand malleable mold.

5. The kit of claim 1 wherein the container is a dispensing container through which the light curable polymer is dispensed.

6. The kit of claim 1 wherein the light curable polymer is cured in either the visible or near visible light ranges.

7. The kit of claim 1 wherein the at least one sheet includes one or more separate sheets of transparent material.

8. The kit of claim 1 further including coloring which can be added to the light curable polymer after the light curable polymer is dispensed from the container.

9. The kit of claim 1 all contained within a single package.

10. A kit for creating a 3-dimensional toy comprising:
a separate battery powered flashlight;
a separate container filled with a light curable polymer;
a plurality of separate perimeter only molds each forming an aperture which defines the sides of the molds into which the light curable polymer is inserted;
a separate transparent sheet upon which the molds can be placed to define the bottom of the toy and to which the light curable polymer does not adhere; and
separate coloring, all contained within a single package.

11. A method of forming a 3-dimensional toy from a kit comprising a battery powered flashlight, a container filled with a light curable polymer, one or more molds into which the light curable polymer is inserted, and separate package of coloring, all contained within a single package, the method comprising the following steps:
a. opening the package and obtaining one of the molds;
b. dispensing the light curable polymer from the container into the obtained mold;
c. adding the coloring to the light curable polymer after the light curable polymer has been dispensed and before curing; and
d. curing the light curable polymer by applying light in the visible or near visible range to the light curable polymer via the battery powered flashlight.

12. The method of claim 11 further including the step of adding the coloring to the light curable polymer after curing.

13. The method of claim 11 wherein the step of dispensing the light curable polymer involves squeezing the polymer from a dispensing tube.

14. The method of claim 11 further including one or more separate sheets upon which the molds can be placed and to which the light curable polymer does not adhere.

* * * * *